US010872520B1

(12) United States Patent
Smith et al.

(10) Patent No.: US 10,872,520 B1
(45) Date of Patent: Dec. 22, 2020

(54) SYSTEMS AND METHODS FOR MANAGING SUPERVISION SIGNALS

(71) Applicant: Tyco Safety Products Canada Ltd., Concord (CA)

(72) Inventors: Derek Carl Smith, Ontario (CA); Stephane Foisy, Udora (CA)

(73) Assignee: TYCO SAFETY PRODUCTS CANADA LTD., Ontario (CA)

( * ) Notice: Subject to any disclaimer, the term of this patent is extended or adjusted under 35 U.S.C. 154(b) by 0 days.

(21) Appl. No.: 16/667,449

(22) Filed: Oct. 29, 2019

(51) Int. Cl.
*G08B 29/16* (2006.01)

(52) U.S. Cl.
CPC ..... *G08B 29/16* (2013.01)

(58) Field of Classification Search
CPC ..... G08B 29/02; G08B 29/04; G08B 29/043; G08B 29/12; G08B 29/145; G08B 29/181; G08B 19/005; G08B 25/08; G08B 29/16; H04W 40/28; H04W 40/34
USPC ..... 340/506, 507, 508, 531, 541, 628; 370/225, 227, 228
See application file for complete search history.

(56) References Cited

U.S. PATENT DOCUMENTS 8,493,202 B1 * 7/2013 Trundle ..... G08B 29/046 340/502
9,013,980 B2 * 4/2015 Lontka ..... G01R 31/50 370/221
2013/0336130 A1 * 12/2013 Kore ..... H04K 3/825 370/252
2016/0100348 A1 * 4/2016 Cohn ..... G08B 19/005 370/225

* cited by examiner

*Primary Examiner* — Hung T Nguyen
(74) *Attorney, Agent, or Firm* — Arent Fox, LLP

(57) ABSTRACT

Aspects of the present disclosure include methods, systems, and non-transitory computer readable media that perform the steps of determining, in response to receiving a first failed supervision signal, a notification signal, or failing to receive a first anticipated supervision signal, that at least the first communication channel is entering into a failure state or in the failure state, monitoring, in response to determining that the first communication channel is entering into a failure state or in the failure state, a second communication channel for a second supervision signal from the security device, and receiving the second supervision signal from the security device via the second communication channel.

24 Claims, 7 Drawing Sheets

SYSTEMS AND METHODS FOR MANAGING SUPERVISION SIGNALS

BACKGROUND

Certain assets may be monitored by a security system for intrusion, fire, flood, or other emergencies. In an emergency, the security system may transmit an alert signal to a monitoring server indicating the occurrence of emergency. The monitoring server may transmit signals to appropriate authorities to summon assistance to the assets. To ensure that the assets are being actively monitored by the security system, the security system may periodically transmit supervision signals to the monitoring server indicating the status of the security system. The security system may transmit the supervision signals on more than one communication channels. However, some communication channels may fail and/or disrupt the transmission of the supervision signals. Some communication channels may require more power and thus transmit less signals to conserve battery/standby power. Further, some communication channels may be more costly than others when transmitting supervision signals. Therefore, improvements in monitoring the security system may be desirable.

SUMMARY

This summary is provided to introduce a selection of concepts in a simplified form that are further described below in the DETAILED DESCRIPTION. This summary is not intended to identify key features of the claimed subject matter, nor is it intended to be used as an aid in determining the scope of the claimed subject matter.

Aspects of the present disclosure include methods, systems, and non-transitory computer readable media that perform the steps of transmitting a first supervision signal to a server via a first communication channel, receiving a first response signal from the server via the first communication channel, determining, in response to the first response signal, that at least the first communication channel is entering into a failure state or in the failure state, and transmitting, in response to determining that the first communication channel is entering into a failure state or in the failure state, a second supervision signal to the server via a second communication channel.

An aspect of the present disclosure includes a method including determining, in response to receiving a first failed supervision signal, receiving a notification signal, or failing to receive a first anticipated supervision signal, that at least the first communication channel is entering into a failure state or in the failure state, monitoring, in response to determining that the first communication channel is entering into a failure state or in the failure state, a second communication channel for a second supervision signal from the security device, and receiving the second supervision signal from the security device via the second communication channel.

Aspects of the present disclosure includes a system having a memory that stores instructions and a processor configured to execute the instructions to perform the steps of determining, in response to receiving a first failed supervision signal, receiving a notification signal, or failing to receive a first anticipated supervision signal, that at least the first communication channel is entering into a failure state or in the failure state, monitoring, in response to determining that the first communication channel is entering into a failure state or in the failure state, a second communication channel for a second supervision signal from the security device, and receiving the second supervision signal from the security device via the second communication channel.

Certain aspects of the present disclosure includes a non-transitory computer readable medium having instructions stored therein that, when executed by a processor, cause the processor to perform the steps of determining, in response to receiving a first failed supervision signal, receiving a notification signal, or failing to receive a first anticipated supervision signal, that at least the first communication channel is entering into a failure state or in the failure state, monitoring, in response to determining that the first communication channel is entering into a failure state or in the failure state, a second communication channel for a second supervision signal from the security device, and receiving the second supervision signal from the security device via the second communication channel.

BRIEF DESCRIPTION OF THE DRAWINGS

The features believed to be characteristic of aspects of the disclosure are set forth in the appended claims. In the description that follows, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objects and advantages thereof, will be best understood by reference to the following detailed description of illustrative aspects of the disclosure when read in conjunction with the accompanying drawings, wherein:

DETAILED DESCRIPTION

The following includes definitions of selected terms employed herein. The definitions include various examples and/or forms of components that fall within the scope of a term and that may be used for implementation. The examples are not intended to be limiting.

The term "processor," as used herein, can refer to a device that processes signals and performs general computing and arithmetic functions. Signals processed by the processor can include digital signals, data signals, computer instructions, processor instructions, messages, a bit, a bit stream, or other computing that can be received, transmitted and/or detected. A processor, for example, can include microprocessors, microcontrollers, digital signal processors (DSPs), field programmable gate arrays (FPGAs), programmable logic devices (PLDs), state machines, gated logic, discrete hardware circuits, and other suitable hardware configured to perform the various functionality described herein.

The term "bus," as used herein, can refer to an interconnected architecture that is operably connected to transfer data between computer components within a singular or multiple systems. The bus can be a memory bus, a memory controller, a peripheral bus, an external bus, a crossbar switch, and/or a local bus, among others.

The term "memory," as used herein, can include volatile memory and/or nonvolatile memory. Non-volatile memory can include, for example, ROM (read only memory), PROM (programmable read only memory), EPROM (erasable PROM) and EEPROM (electrically erasable PROM). Volatile memory can include, for example, RAM (random access memory), synchronous RAM (SRAM), dynamic RAM (DRAM), synchronous DRAM (SDRAM), double data rate SDRAM (DDR SDRAM), and direct RAM bus RAM (DRRAM).

In some aspects of the present disclosure, a security system may transmit supervision signals to a monitoring server on a first communication channel at a higher rate and supervision/status signals to the monitoring server on a second communication channel at a lower rate. When the supervision signals on a first communication channel become unstable, the monitoring server may begin monitoring a second communication channel for supervision signals at the higher rate. After a predetermined duration of unstable supervision signals on the first communication channel, the security system may begin transmitting supervision signals on the second communication channel at the higher rate to the monitoring server.

Figure 1:
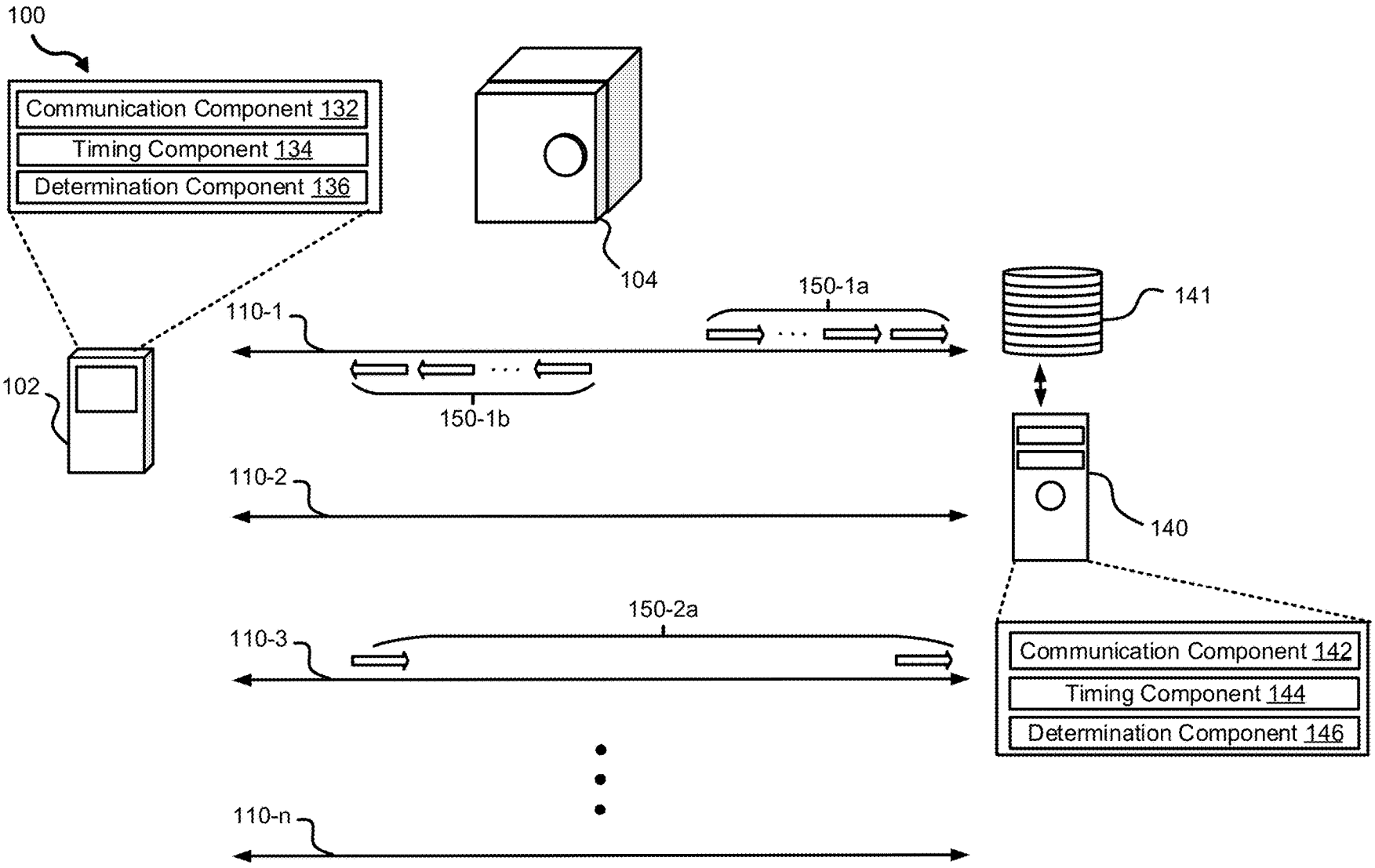
FIG. 1 illustrates an example of a security device operating in a normal operation state in accordance with aspects of the present disclosure.

Referring to FIG. 1, in a non-limiting implementation, an example of a security system 100 (e.g., security monitoring) may include a security device 102. The security device 102 may monitor one or more assets 104 via a plurality of sensors (not shown), such as motion sensors, proximity sensors, fire detectors, flood detectors, etc. The security device 102 may be a security panel having communication circuits (e.g., cellular radio). The security device 102 may receive signals from the plurality of sensors indicating the detection of at least one of intruders, fires, floods, etc. The security device 102 may include a communication component 132 that sends and/or receives data to/from the monitoring server 140. The security device 102 may include a determination component 136 that determines the primary channel is in the failure state and chooses a secondary channel to replace a primary channel (discussed below) when the primary channel is in the failure state. The security device 102 may include a timing component 134 that tracks the frequency and/or occurrence of response signals.

In some instances, the security system 100 may include a monitoring server 140 and an optional data repository 141. The monitoring server 140 may include a communication component 142 that sends and/or receives data to/from the security device 102. The monitoring server 140 may include a timing component 144 that tracks the frequency and/or occurrence of successful and/or failed supervision signals (described in detail below). The monitoring server 140 may include a determination component 146 that determines when the communication channel is in the failure state.

In some implementations, the security system 100 may include a plurality of communication channels 110. The plurality of communication channels 110 may include Ethernet communication channels, internet communication channels, broadband communication channels, wireless-fidelity (Wi-Fi) communication channels, long range radio communication channels, cellular communication channels (e.g., New Radio, Long Term Evolution, Global System for Mobile, Code Division Multiple Access, etc.), satellite communication channels, short message service (SMS) communication channels, or other communication channels suitable for transmitting supervision signals. For example, the first communication channel 110-1 may be an internet communication channel, the second communication channel 110-2 may be a satellite communication channel, the third communication channel 110-3 may be a cellular communication channel, and so forth. It may be less costly to transmit the same number of supervision signals on the first communication channel 110-1 than the third communication channel 110-3.

During the normal operation state of the security system 100 as illustrated in FIG. 1, in some instances, the security device 102 may transmit a first plurality of supervision signals **150-*la* to the monitoring server 140 over the first communication channel 110-1 (e.g., a primary channel). The first plurality of supervision signals 150-*la* may include supervision signals transmitted at a first predetermined interval, such as every 30 seconds, 1 minute, 2 minutes, 5 minutes, or longer. Each supervision signal of the first plurality of supervision signals 150-*la* may include data structures (e.g., messages, packets, texts) that carry information such as time stamp, status of the security device 102, identifier for the security device 102, etc. In response to receiving the first plurality of supervision signals 150-1*a*, the monitoring server 140 may transmit a first plurality of response signals 150-1*b*. The first plurality of response signals 150-1*b* may indicate to the security device 102 that the monitoring server 140 successfully received the first plurality of supervision signals 150-1*a*. The first plurality of response signals 150-1*b* may include acknowledgement (ACK) information, control information (e.g., changing the first predetermined interval), updates, or other relevant information for the security device 102**.

In some examples, the security device 102 may transmit a plurality of status signals **150-2*a* to the monitoring server 140 over the third communication channel 110-3 (e.g., a secondary channel) at a second predetermined interval, such as every 6 hours, 12 hours, 24 hours, or longer. The monitoring server 140 may rely on the first plurality of supervision signals 150-*la* to monitor the one or more assets 104, the integrity of the security device 102 (e.g., an intruder disabling the security device 102), and/or the integrity of the first communication channel 110-1 (e.g., a power outage at the internet service provider may disrupt the first communication channel 110-1). The monitoring server 140 may rely on the plurality of status signals 150-2*a* to monitor the status and/or integrity of the third communication channel 110-3 (e.g., a server upgrade at the cellular service provider may disrupt the third communication channel 110-3). In other words, the monitoring server 140 may rely on the signals on one or more primary channels (i.e., the first communication channel 110-1) to monitor the security device 102, and the signals on one or more secondary channels to monitor the statuses of the secondary channels. The cost per unit data transmitted for the first communication channel 110-1 may be lower than the cost per unit data transmitted for the third communication channel 110-3. In other examples, the power consumption per unit data transmitted for the first communication channel 110-1 may be higher than the power consumption per unit data transmitted for the third communication channel 110-3**.

Figure 2:
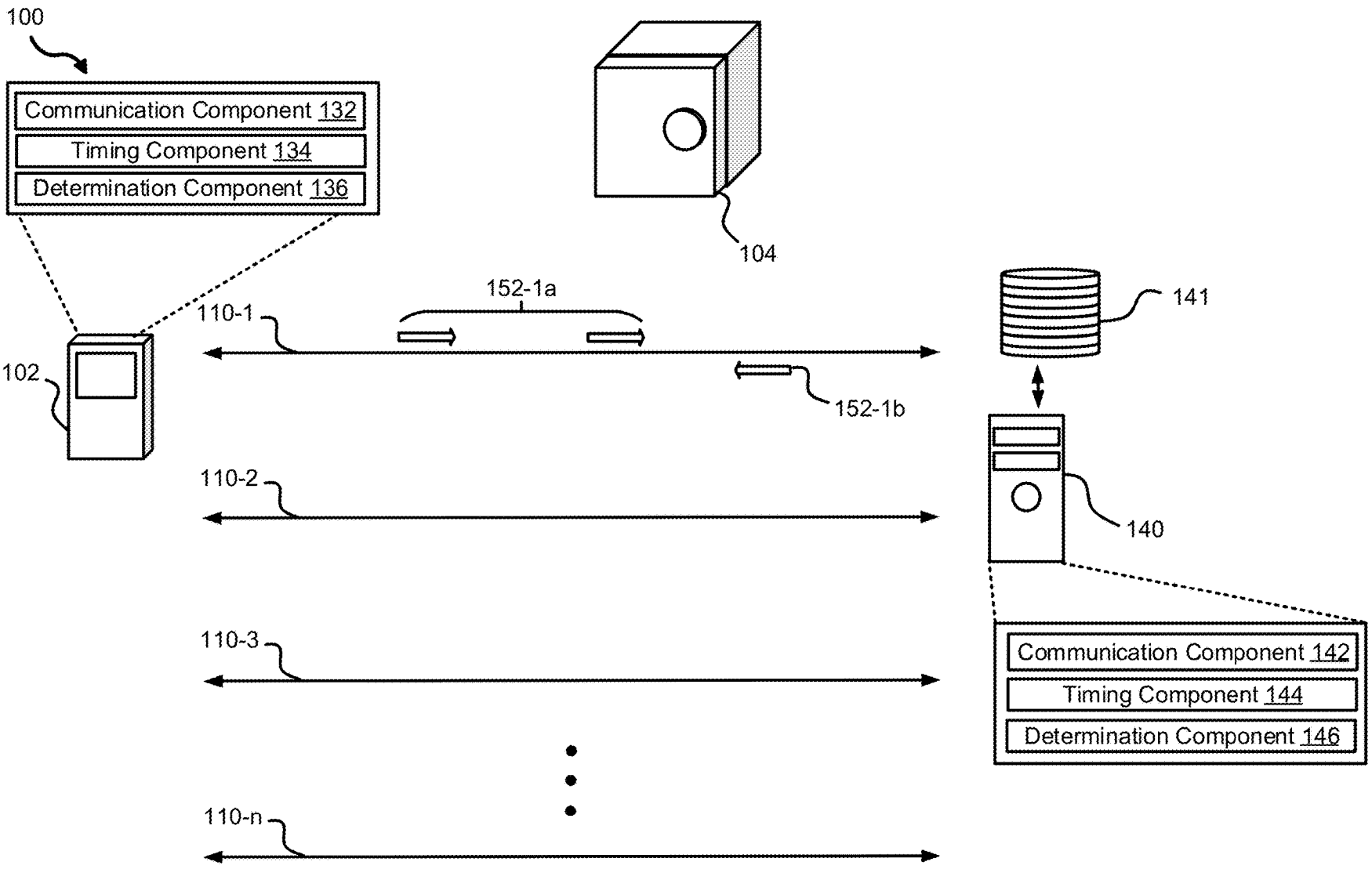
FIG. 2 illustrates an example of a security device having a channel operating in a failure state in accordance with aspects of the present disclosure.

Turning to FIG. 2, the security system 100 may include a channel operating in the failure state. The failure state may indicate that one or more of the primary channels is failing. For example, an intruder may sever a hardline associated with the primary channel, and resulting in no signals (i.e., supervision or response) being transmitted/received. In certain non-limiting examples, the security device 102 may transmit a second plurality of supervision signals 152-*la* on the first communication channel 110-1. The second plurality of supervision signals 152-*la* may be a portion of the supervision signals intended to be transmitted by the security device 102 (e.g., the first plurality of supervision signals 150-1*a*). For example, the second plurality of supervision signals 152-*la* may include supervision signals transmitted at unintentionally irregular intervals (e.g., interference impacting the first communication channel 110-1), failed supervision signals (e.g., supervision signals that the monitoring server 140 cannot properly decode), supervision signals with low signal to noise ratio (SNR) due to channel noise (e.g., below a predetermined threshold, such as 10-15 decibels), and/or lost signals due to adverse channel conditions (e.g., the service provider operating the first communication channel 110-1 experiences a power outage and/or equipment failure). In response to receiving the second plurality of supervision signals 152-1*a*, the communication component 142 of the monitoring server 140 may transmit one or more response signals 152-1*b* to the security device 102. In some instances, the monitoring server 140 may be unable to decode some of the second plurality of supervision signals 152-1*a*. In some examples, the one or more response signals 152-1*b* may include ACK information of some of the second plurality of supervision signals 152-*la* and not others.

In some instances, the communication component 142 of the monitoring server 140 may receive the second plurality of supervision signals 152-1*a*. In response, the timing component 144 of the monitoring server 140 may track at least one of a number of successful supervision signals (e.g., supervision signals that the monitoring server 140 can decode) in the second plurality of supervision signals 152-1*a*, the intervals between successful supervision signals in the second plurality of supervision signals 152-1*a*, the SNR of the second plurality of supervision signals 152-1*a*, and/or other parameters used to determine the quality of the first communication channel 110-1.

In some non-limiting examples, the determination component 146 may determine that the first communication channel 110-1 is in the failure state. In one example, the determination component 146 may determine a failure state after not receiving any supervision signals. For example, the determination component 146 may determine a failure state after receiving a predetermined number of failed supervision signals. In another example, the determination component 146 may determine a failure state after receiving failed supervision signals over a predetermined amount of time. In some examples, the determination component 146 may determine a failure state when a ratio of failed supervision signals versus successful supervision signals exceeds a predetermined threshold. In a non-limiting example, the determination component 146 may determine a failure state after receiving successful supervision signals at intervals other than the predetermined interval (e.g., the first interval). Other algorithms for determining a failed state may be used.

In optional implementations, the determination component 146 of the monitoring server 140 may determine, in response to the monitoring server 140 receiving the second plurality of supervision signals 152-1*a*, that the first communication channel 110-1 is in the failure state because the security device 102 may transmit a confirmation signal (not shown) to the monitoring server 140 on at least one of the second communication channel 110-2, the third communication channel 110-3, . . . the $n^{th}$ communication channel 110-*n* indicating that the security device 102 is functioning properly.

In some aspects, the communication component 132 of the security device 102 may receive the one or more response signals 152-1*b* in response to the second plurality of supervision signals 152-1*a*. The determination component 136 may determine that the first communication channel 110-1 is in the failure state because the one or more response signals 152-1*b* do not include the ACK information associated with at least some of the second plurality of supervision signals 152-*la* (e.g., due to failed supervision signals not decoded by the monitoring server 140. In other instances, the determination component 136 may determine that the first communication channel 110-1 is in the failure state because of excessive delay (i.e., longer than predetermined intervals) in receiving the ACK information, network compromised (e.g., spoofing attack, replay attack, etc.), or the monitoring server 140 enters into a maintenance service mode indicating the transmitter to use the alternate path during maintenance, and/or local connection loss.

In another aspect of the present disclosure the communication component 132 may transmit a notification signal to the monitoring server 140 indicating that the first communication channel 110-1 is entering into a failure state (e.g., scheduled maintenance, scheduled power down, etc.). In some instances, the security device 102 may switch (in real time or substantially real time) to the third communication channel 110-3 instead for waiting for the first communication channel 110-1 to enter the failure state.

Figure 3:
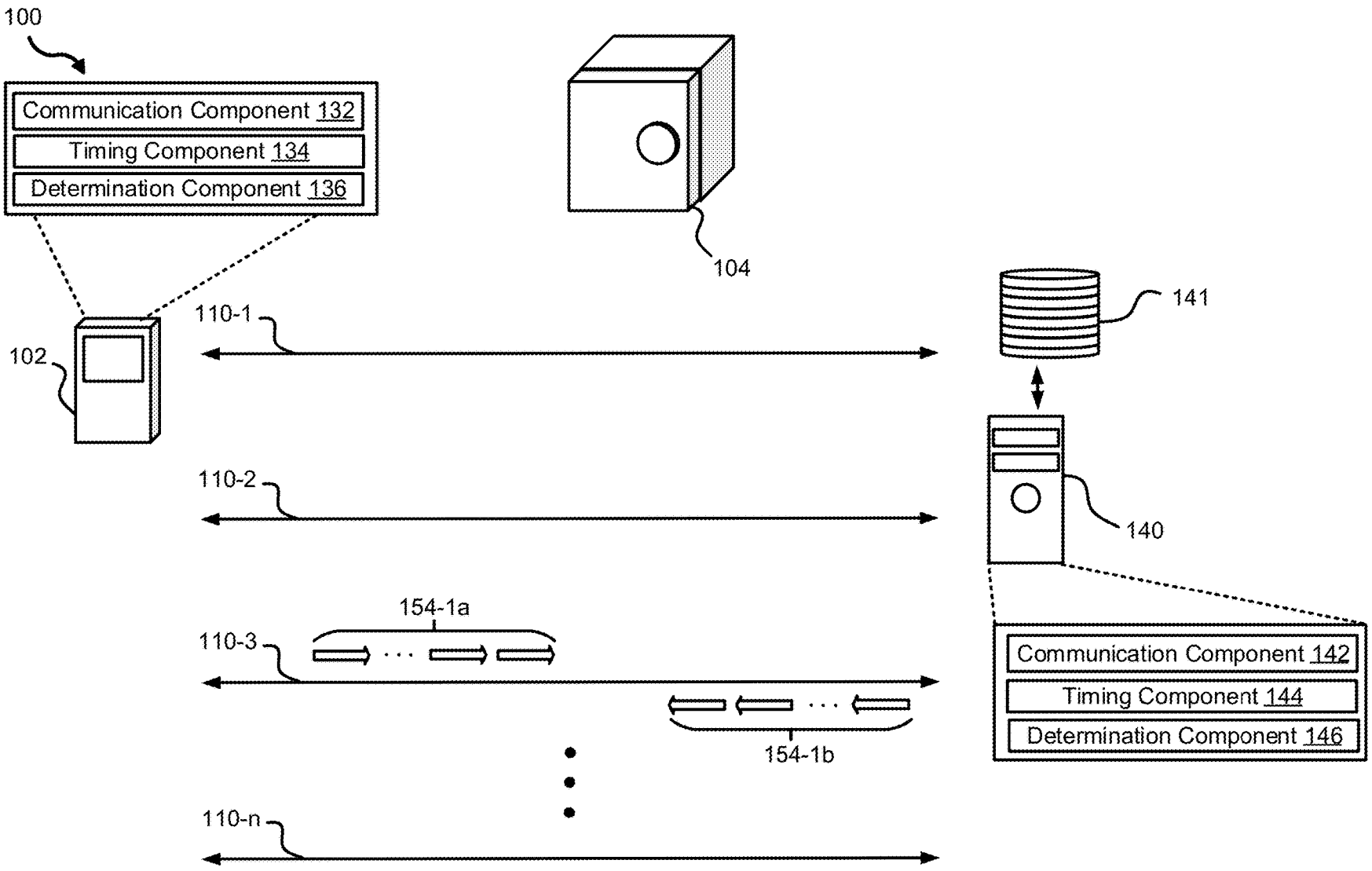
FIG. 3 illustrates an example of a security device operating in the by-pass mode in accordance with aspects of the present disclosure.

Turning to FIG. 3, an example of the security system 100 may operate in the by-pass mode. In the by-pass mode, one or more secondary channels may temporarily replace one or more primary channels. For example, after the determination component 136 of the security device that the first communication channel 110-1 is in the failure state, the determination component 136 may transmit instructions to the communication component 132 to transmit a third plurality of supervision signals 154-*la* on the third communication channel 110-3. The third plurality of supervision signals 154-*la* may include supervision signals transmitted at a third predetermined interval, such as every 30 seconds, 1 minute, 2 minutes, 5 minutes, or longer. Due to the failure state of the first communication channel 110-1, the determination component 136 of the security device 102 may select, for example, the third communication channel 110-3 to replace the first communication channel 110-1 as the primary channel during the by-pass mode. For example, when the third communication channel 110-3 replaces the primary channel during the by-pass mode, the third communication channel 110-3 transmits supervision signals at the same or different rate as the primary channel that the third communication channel is replacing.

In other examples, after the determination component 146 determines that the first communication channel 110-1 is in the failure state, the determination component 146 may transmit instructions to the communication component 142 to monitor channels other than the first communication channel 110-1, such as the third communication channel 110-3, for incoming supervision signals. The monitoring server 140 may receive the third plurality of supervision signals 154-1*a*. In response to receiving the third plurality of supervision signals 154-1*a*, the monitoring server 140 may transmit a third plurality of response signals 154-1*b*. The third plurality of response signals 154-1*b* may indicate to the security device 102 that the monitoring server 140 successfully received the third plurality of supervision signals 154-1*a*. The third plurality of response signals 154-1*b* may include acknowledgement (ACK) information, control information (e.g., changing the first predetermined interval), updates, or other relevant information for the security device 102. In a non-limiting example, the monitoring server 140 may monitor the security device 102 via the third communication channel 110-3 (serving as the substitute primary channel during the by-pass mode).

In some implementations, the determination component 136 of the security device 102 may switch the primary channel from the first communication channel 110-1 to the third communication channel 110-3 after the first communication channel 110-1 remains in the failure state for a predetermined amount of wait time (e.g., 30 seconds, 1 minute, 5 minutes, 10 minutes, or more) as determined by a timing component 134.

In certain implementations, the determination component 136 of the security device 102 may switch the primary channel from the first communication channel 110-1 to the third communication channel 110-3 after failing to receive a predetermined amount of ACK information for supervision signals sent.

In some instances, the determination component 136 of the security device 102 may switch the primary channel from the first communication channel 110-1 to the third communication channel 110-3 after failing to receive any ACK information or a number of expected ACK signals for a predetermined amount of wait time as determined by the timing component 134.

In other examples, the determination component 136 of the security device 102 may switch the primary channel from the first communication channel 110-1 to the third communication channel 110-3 after receiving an indication signal from the monitoring server 140 on one of the communication channels 110 other than the first communication channel 110-1.

In some implementations, the determination component 136 of the security device 102 may switch the primary channel from the first communication channel 110-1 to the third communication channel 110-3 after sending the notification signal to the monitoring server 140 indicating that the first communication channel 110-1 is entering into the failure state (e.g., scheduled maintenance, power down, battery replacement, etc.).

Figure 4:
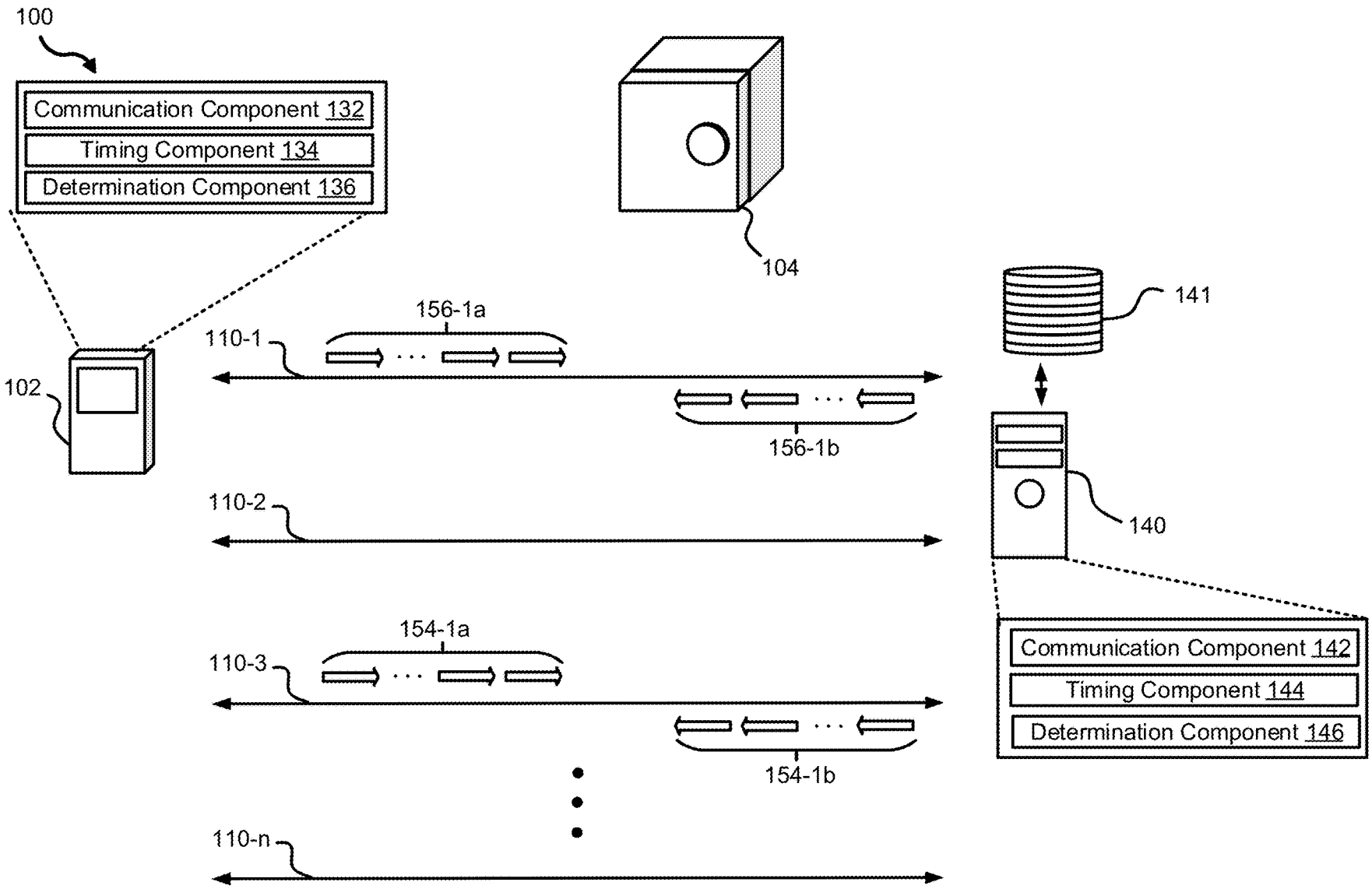
FIG. 4 illustrates an example of a security device operating in the recover mode in accordance with aspects of the present disclosure.

Turning to FIG. 4, an example of the security system 100 may operate in the recovery mode. In the recovery mode, the previously failed primary channel may be in the process of restoring to the normal operational state while the substitute primary channel transmits supervision signals. For example, the security device 102 may transmit the third plurality of supervision signals 154-*la* on the third communication channel 110-3 while transmitting a fourth plurality of supervision signals 156-1*a* on the first communication channel 110-1. The fourth plurality of supervision signals 156-1*a* may include supervision signals transmitted at a fourth predetermined interval, such as every 30 seconds, 1 minute, 2 minutes, 5 minutes, or longer. The security device 102 may transmit the fourth plurality of supervision signals 156-1*a* to test whether the first communication channel 110-1 has recovered from the failure state.

In some instances, the communication component 142 of the monitoring server 140 may receive the fourth plurality of supervision signals 156-1*a*. In response to receiving the fourth plurality of supervision signals 156-1*a*, the communication component 142 of the monitoring server 140 may transmit a fourth plurality of response signals 156-1*b* to the security device 102. Based on the fourth plurality of response signals 156-1*b* (e.g., the number of successful supervision signals exceeding a predetermined threshold), the determination component 136 of the security device 102 may determine that the first communication channel 110-1 is no longer in the failure state and/or switch the primary channel back to the first communication channel 110-1 as shown in FIG. 1. Specifically, the security device 102 may resume transmitting the first plurality of supervision signals 150-1*a* on the first communication channel 110-1 and the first plurality of status signals 150-2*a* on the third communication channel 110-3. As a result, the security device 102 may prevent unnecessary transmission on the third communication channel 110-3 (higher cost per data transmitted than the first communication channel 110-1) after the first communication channel 110-1 is no longer in the failure state.

In optional implementations, if all the communication channels 110 fail, the security device 102 and/or the monitoring server 140 may contact security personnel and/or authority.

Figure 5:
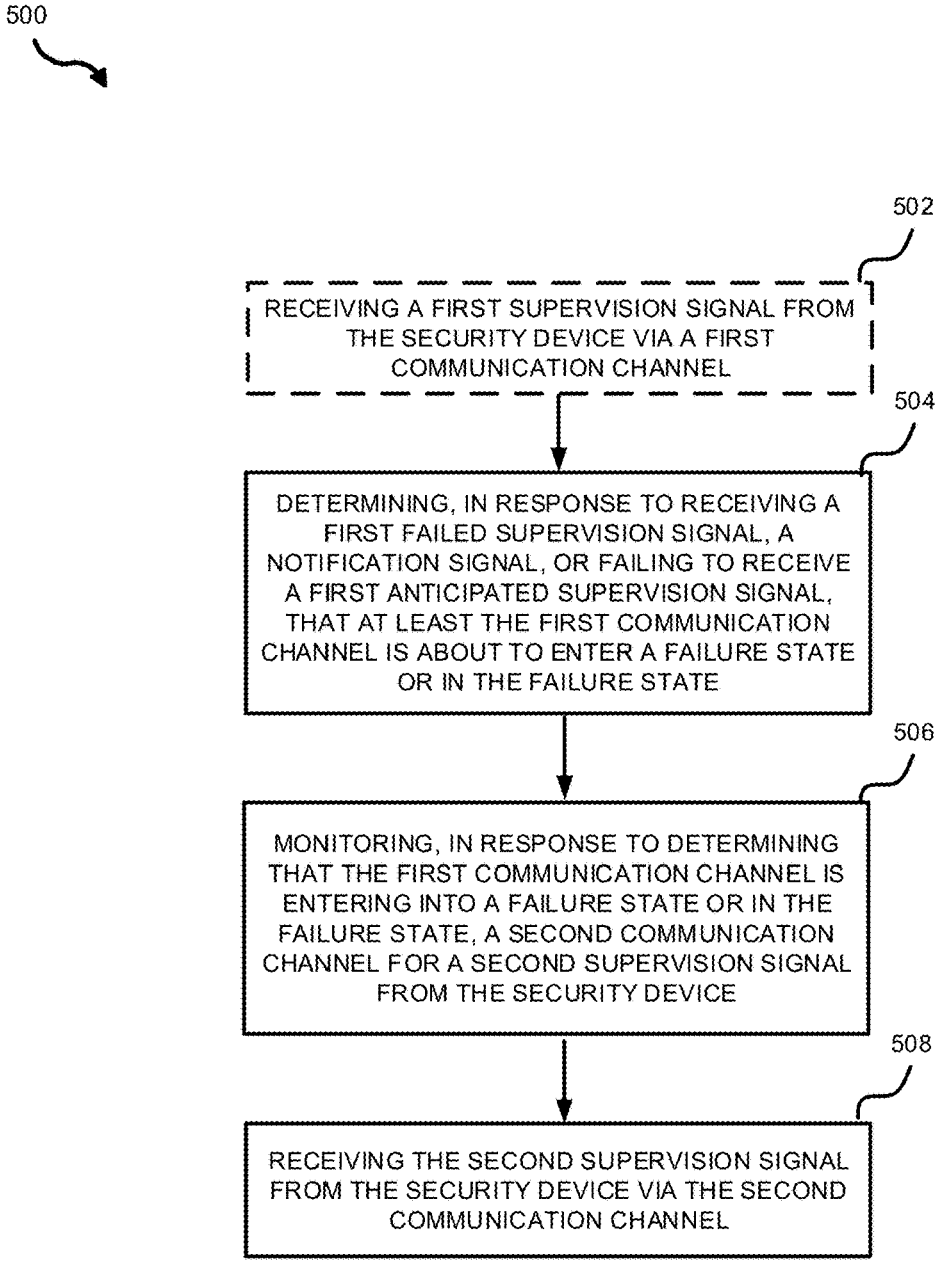
FIG. 5 illustrates an example of a method for receiving supervision signals in accordance with aspects of the present disclosure.

Turning to FIG. 5, an example of a method 500 for receiving supervision signals may be performed by the monitoring server 140 and/or one or more of the communication component 142, the timing component 144, and/or the determination component 146.

At block 502, the method 500 may optionally receive a first supervision signal from the security device via a first communication channel. For example, the communication component 142 of the monitoring server 140 may receive one or more of the second plurality of supervision signals 152-*la* via the first communication channel 110-1.

At block 504, the method 500 may determine, in response to the first supervision signal, that at least the first communication channel is entering into a failure state or in the failure state. For example, the timing component 144 and/or determination component 146 may determine that the first communication channel 110-1 is in the failure state. For example, the determination component 146 may determine a failure state after receiving a predetermined number of failed supervision signals. In another example, the determination component 146 may determine a failure state after receiving consecutive failed supervision signals over a predetermined amount of time. In some examples, the determination component 146 may determine a failure state when a ratio of failed supervision signals versus successful supervision signals exceeds a predetermined threshold. In a non-limiting example, the determination component 146 may determine a failure state after receiving successful supervision signals at intervals other than the predetermined interval (e.g., the first interval).

At block 506, the method 500 may monitor, in response to determining that the first communication channel is entering into a failure state or in the failure state, a second communication channel for a second supervision signal from the security device. For example, the communication component 142 may monitor the third communication channel 110-3 for supervision signals transmitted by the security device 102 due to the first communication channel 110-1 being in the failure state.

At block 508, the method 600 may receive the second supervision signal from the security device via the second communication channel. For example, the communication component 142 may receive the third plurality of supervision signals 154-*la* from the security device 102 via the third communication channel 110-3.

In optional implementations, the method 600 may suspend an alarm (e.g., a siren, a flashing light, a local annunciation of the trouble) associated with determining the failure state at the security device in response to receiving the second supervision signal. The method 600 may wait until a time at which the local user can respond to the issue (e.g., waking hours, activity seen in the premises, hours of operation etc.).

Figure 6:
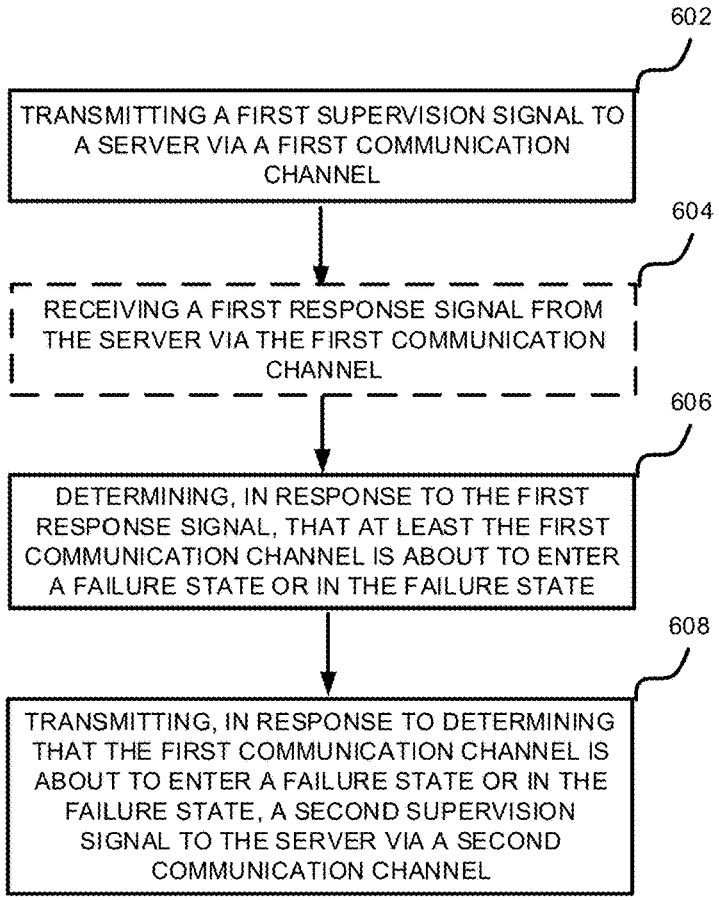
FIG. 6 illustrates an example of a method for transmitting supervision signals in accordance with aspects of the present disclosure.
Figure 7:
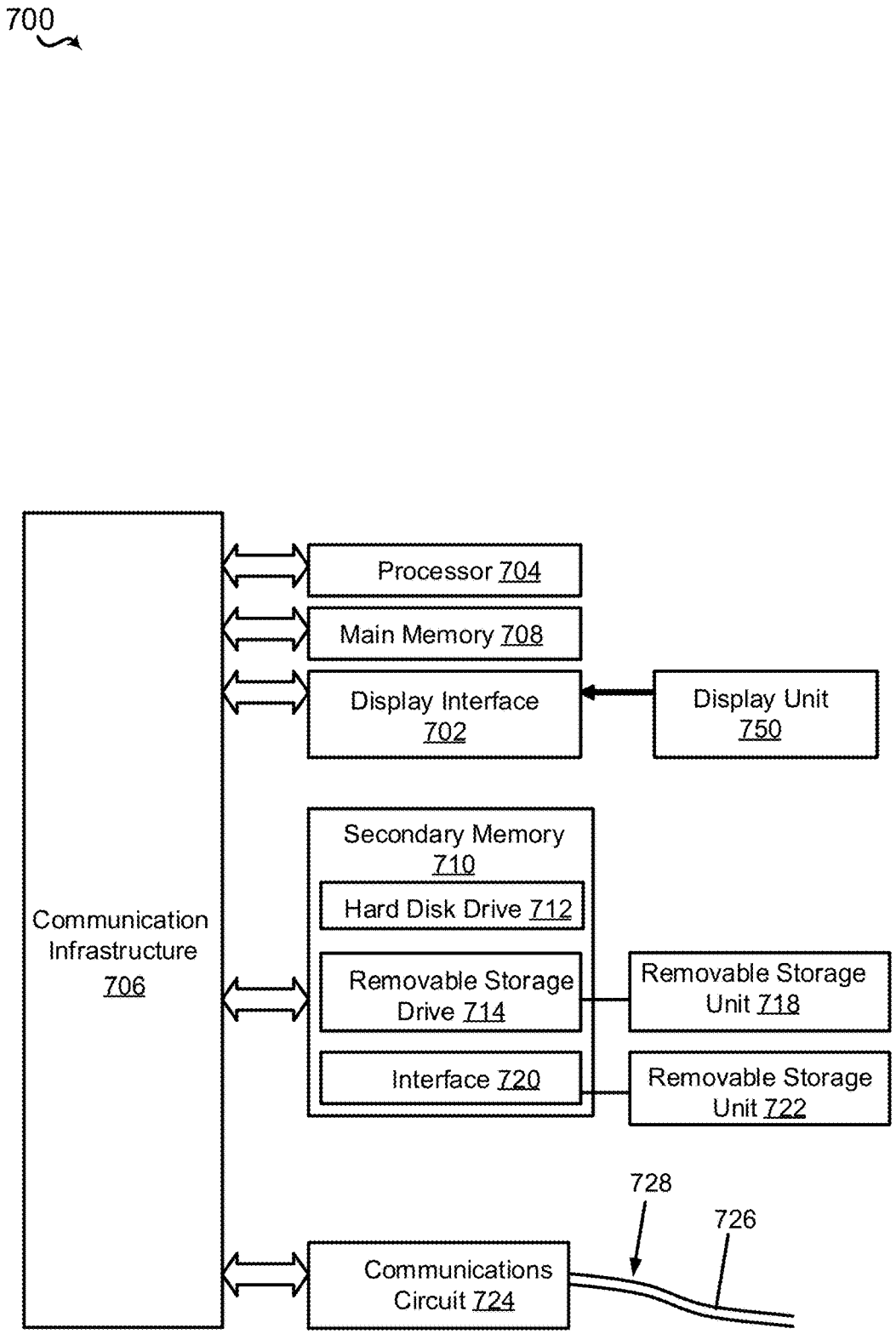
FIG. 7 illustrates an example of a computer system in accordance with aspects of the present disclosure.

Turning to FIG. 6, an example of a method 600 for transmitting supervision signals may be performed by the security device 102 and/or one or more of the communication component 132 and/or the determination component 136.

At block 602, the method 600 may transmit a first supervision signal to a monitoring server via a first communication channel. For example, the communication component 132 of the security device 102 may transmit one or more of the second plurality of supervision signals 152-*la* to the monitoring server 140 via the first communication channel 110-1.

At block 604, the method 600 may receive a first response signal from the server via the first communication channel. For example, the communication component 132 of the security device 102 may receive the one or more response signals 152-1*b* from the monitoring server 140.

At block 606, the method may determine, in response to the first response signal, that at least the first communication channel is in a failure state. For example, the determination component 136 may determine that the first communication channel 110-1 is in the failure state because the one or more response signals 152-1*b* do not include the ACK information associated with at least some of the second plurality of supervision signals 152-*la* (e.g., due to failed supervision signals not decoded by the monitoring server 140.

At block 608, the method 600 may transmit, in response to determining that the first communication channel is in the failure state, a second supervision signal to the server via a second communication channel. For example, the communication component 132 of the security device 102 may transmit at least one of the third plurality of supervision signals 154-1*a* on the third communication channel 110-3 after determining that the first communication channel 110-1 is in the failure state.

The computer system 700 includes one or more processors, such as processor 704. The processor 704 is connected with a communication infrastructure 706 (e.g., a communications bus, cross-over bar, or network). Various software aspects are described in terms of this example computer system. After reading this description, it will become apparent to a person skilled in the relevant art(s) how to implement aspects of the disclosures using other computer systems and/or architectures.

The computer system 700 may include a display interface 702 that forwards graphics, text, and other data from the communication infrastructure 706 (or from a frame buffer not shown) for display on a display unit 750. Computer system 700 also includes a main memory 708, preferably random access memory (RAM), and may also include a secondary memory 710. The secondary memory 710 may include, for example, a hard disk drive 712, and/or a removable storage drive 714, representing a floppy disk drive, a magnetic tape drive, an optical disk drive, a universal serial bus (USB) flash drive, etc. The removable storage drive 714 reads from and/or writes to a removable storage unit 718 in a well-known manner. Removable storage unit 718 represents a floppy disk, magnetic tape, optical disk, USB flash drive etc., which is read by and written to removable storage drive 714. As will be appreciated, the removable storage unit 718 includes a computer usable storage medium having stored therein computer software and/or data. In some examples, one or more of the main memory 708, the secondary memory 710, the removable storage unit 718, and/or the removable storage unit 722 may be a non-transitory memory.

Alternative aspects of the present disclosures may include secondary memory 710 and may include other similar devices for allowing computer programs or other instructions to be loaded into computer system 700. Such devices may include, for example, a removable storage unit 722 and an interface 720. Examples of such may include a program cartridge and cartridge interface (such as that found in video game devices), a removable memory chip (such as an erasable programmable read only memory (EPROM), or programmable read only memory (PROM)) and associated socket, and other removable storage units 722 and interfaces 720, which allow software and data to be transferred from the removable storage unit 722 to computer system 700.

Computer system 700 may also include a communications circuit 724. The communications circuit 724 may allow software and data to be transferred between computer system 700 and external devices. Examples of the communications circuit 724 may include a modem, a network interface (such as an Ethernet card), a communications port, a Personal Computer Memory Card International Association (PCMCIA) slot and card, etc. Software and data transferred via the communications circuit 724 are in the form of signals 728, which may be electronic, electromagnetic, optical or other signals capable of being received by the communications circuit 724. These signals 728 are provided to the communications circuit 724 via a communications path (e.g., channel) 726. This path 726 carries signals 728 and may be implemented using wire or cable, fiber optics, a telephone line, a cellular link, an RF link and/or other communications channels. In this document, the terms "computer program medium" and "computer usable medium" are used to refer generally to media such as the removable storage unit 718, a hard disk installed in hard disk drive 712, and signals 728. These computer program products provide software to the computer system 700. Aspects of the present disclosures are directed to such computer program products.

Computer programs (also referred to as computer control logic) are stored in main memory 708 and/or secondary memory 710. Computer programs may also be received via communications circuit 724. Such computer programs, when executed, enable the computer system 700 to perform the features in accordance with aspects of the present disclosures, as discussed herein. In particular, the computer programs, when executed, enable the processor 704 to perform the features in accordance with aspects of the present disclosures. Accordingly, such computer programs represent controllers of the computer system 700.

In an aspect of the present disclosures where the method is implemented using software, the software may be stored in a computer program product and loaded into computer system 700 using removable storage drive 714, hard drive 712, or communications interface 720. The control logic (software), when executed by the processor 704, causes the processor 704 to perform the functions described herein. In another aspect of the present disclosures, the system is implemented primarily in hardware using, for example, hardware components, such as application specific integrated circuits (ASICs). Implementation of the hardware state machine so as to perform the functions described herein will be apparent to persons skilled in the relevant art(s).

It will be appreciated that various implementations of the above-disclosed and other features and functions, or alternatives or varieties thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A method of transmitting signals, comprising:

determining, in response to receiving a first failed supervision signal, receiving a notification signal, or failing to receive a first anticipated supervision signal, that at least a first communication channel is entering into a failure state or in the failure state;

monitoring, in response to determining that the first communication channel is entering into a failure state or in the failure state, a second communication channel for a second supervision signal from a security device; and receiving the second supervision signal from the security device via the second communication channel.

2. The method of claim 1, wherein determining the at least the first communication channel is in a failure state comprises at least one of:

receiving a first predetermined number of a first plurality of failed supervision signals;

receiving a second plurality of consecutive failed supervision signals over a first predetermined amount of time;

receiving a third plurality of failed supervision signals and a plurality of successful supervision signals, wherein a ratio of the third plurality of failed supervision signals and the first plurality of successful supervision signals exceeds a predetermined threshold; or receiving a plurality of supervision signals at intervals other than a predetermined interval.

3. The method of claim 1, wherein:

a first cost per unit data transmitted of the first communication channel is lower than a second cost per unit data transmitted of the second communication channel; or a first power consumption per unit data transmitted of the first communication channel is higher than a second power consumption per unit data transmitted of the second communication channel.

4. The method of claim 1, wherein the first communication channel is one of an internet communication channel, a wireless fidelity (Wi-Fi) communication channel, a broadband communication channel, or a short message service (SMS) communication channel.

5. The method of claim 1, wherein the second communication channel is different than the first communication channel.

6. The method of claim 1, further comprising, prior to receiving the first supervision signal, receiving a plurality of supervision signals, wherein each of the plurality of supervision signals is separated from at least an immediately previously signal or an immediately next signal of the plurality of supervision signals at a first predetermined interval.

7. The method of claim 6, further comprising, prior to receiving the second supervision signal, receiving a plurality of status signals, wherein each of the plurality of status signals is separated from at least an immediately previously signal or an immediately next signal of the plurality of status signals at a second predetermined interval.

8. The method of claim 7, wherein the first predetermined interval is between thirty seconds and five minutes and the second predetermined interval is between six hours and twenty four hours.

9. The method of claim 1, wherein the notification signal includes a cause of the failure state.

10. The method of claim 9, wherein the cause of the failure state includes a power outage, low signal strength, link loss, or internet offline.

11. The method of claim 1, further comprising suspending an alarm, a siren, or a local annunciation of a trouble associated with determining the failure state at the security device in response to receiving the second supervision signal.

12. The method of claim 11, wherein suspending further comprises suspending until a time at which a local user is able to respond to the failure state.

13. A non-transitory computer readable medium comprising instructions stored therein that, when executed by a processor of a monitoring server, cause the processor to:

determine, in response to receiving a first failed supervision signal, receiving a notification signal, or failing to receive a first anticipated supervision signal, that at least a first communication channel is entering into a failure state or in the failure state;

monitor, in response to determining that the first communication channel is in the failure state, a second communication channel for a second supervision signal from a security device; and receive the second supervision signal from the security device via the second communication channel.

14. The non-transitory computer readable medium of claim 13, wherein the instructions for determining the at least the first communication channel is in a failure state comprises instructions that, when executed the processor, cause processor to perform at least one of:

receiving a first predetermined number of a first plurality of failed supervision signals;

receiving a second plurality of consecutive failed supervision signals over a first predetermined amount of time;

receiving a third plurality of failed supervision signals and a plurality of successful supervision signals, wherein a ratio of the third plurality of failed supervision signals and the first plurality of successful supervision signals exceeds a predetermined threshold; or receiving a plurality of supervision signals at intervals other than a predetermined interval.

15. The non-transitory computer readable medium of claim 13, wherein:

a first cost per unit data transmitted of the first communication channel is lower than a second cost per unit data transmitted of the second communication channel; or a first power consumption per unit data transmitted of the first communication channel is higher than a second power consumption per unit data transmitted of the second communication channel.

16. The non-transitory computer readable medium of claim 13, wherein the first communication channel is one of an internet communication channel, a wireless fidelity (Wi- Fi) communication channel, a broadband communication channel, or a short message service (SMS) communication channel.

17. The non-transitory computer readable medium of claim 13, wherein the second communication channel is different than the first communication channel.

18. The non-transitory computer readable medium of claim 13, further comprising instructions that, when executed the processor, cause processor to, prior to receiving the first supervision signal, receive a plurality of supervision signals, wherein each of the plurality of supervision signals is separated from at least an immediately previously signal or an immediately next signal of the plurality of supervision signals at a first predetermined interval.

19. The non-transitory computer readable medium of claim 18, further comprising instructions that, when executed the processor, cause processor to, prior to receiving the second supervision signal, receive a plurality of status signals, wherein each of the plurality of status signals is separated from at least an immediately previously signal or an immediately next signal of the plurality of status signals at a second predetermined interval.

20. The non-transitory computer readable medium of claim 19, wherein the first predetermined interval is between thirty seconds and five minutes and the second predetermined interval is between six hours and twenty four hours.

21. A monitoring server, comprising:

memory that stores instructions; and a processor configured to execute the instructions to:

determine, in response to receiving a first failed supervision signal, receiving a notification signal, or failing to receive a first anticipated supervision signal, that at least a first communication channel is entering into a failure state or in the failure state;

monitor, in response to determining that the first communication channel is entering into a failure state or in the failure state, a second communication channel for a second supervision signal from a security device; and receive the second supervision signal from the security device via the second communication channel.

22. The monitoring server of claim 21, wherein to determine the at least the first communication channel is in a failure state the processor is further configured to execute the instructions to perform at least one of:

receiving a first predetermined number of a first plurality of failed supervision signals;

receiving a second plurality of consecutive failed supervision signals over a first predetermined amount of time;

receiving a third plurality of failed supervision signals and a plurality of successful supervision signals, wherein a ratio of the third plurality of failed supervision signals and the first plurality of successful supervision signals exceeds a predetermined threshold; or receiving a plurality of supervision signals at intervals other than a predetermined interval.

23. The monitoring server of claim 21, wherein:

a first cost per unit data transmitted of the first communication channel is lower than a second cost per unit data transmitted of the second communication channel; or a first power consumption per unit data transmitted of the first communication channel is higher than a second power consumption per unit data transmitted of the second communication channel.

24. The monitoring server of claim 21, wherein:

the first communication channel is one of an internet communication channel, a wireless fidelity (Wi-Fi) communication channel, a broadband communication channel, or a short message service (SMS) communication channel; and the second communication channel is one of a cellular communication channel or a satellite communication channel.

* * * * *